US009165524B2

(12) United States Patent
Sohn et al.

(10) Patent No.: US 9,165,524 B2
(45) Date of Patent: Oct. 20, 2015

(54) DISPLAY DEVICE AND DRIVING METHOD THEREOF

(71) Applicant: SAMSUNG DISPLAY CO., LTD., Gyeonggi-Do (KR)

(72) Inventors: Young Soo Sohn, Guri-si (KR); Seok Hwan Roh, Cheonan-si (KR); Jae Hyoung Park, Suwon-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 315 days.

(21) Appl. No.: 13/644,857

(22) Filed: Oct. 4, 2012

(65) Prior Publication Data

US 2013/0314450 A1 Nov. 28, 2013

(30) Foreign Application Priority Data

May 23, 2012 (KR) ..... 10-2012-0054710

(51) Int. Cl.
*G09G 5/10* (2006.01)
*G09G 3/36* (2006.01)

(52) U.S. Cl.
CPC ..... *G09G 3/3696* (2013.01); *G09G 3/3607* (2013.01); *G09G 3/3688* (2013.01); *G09G 2330/045* (2013.01)

(58) Field of Classification Search
CPC ..... G09G 3/3607; G09G 2320/0233
USPC ..... 345/690, 55, 84–104
See application file for complete search history.

(56) References Cited

U.S. PATENT DOCUMENTS

| | | | | |
|---|---|---|---|---|
| 6,459,817 | B1 * | 10/2002 | Matsushiro | 382/251 |
| 7,029,087 | B2 | 4/2006 | Tamura | |
| 8,054,282 | B2 | 11/2011 | Park et al. | |
| 2004/0196237 | A1 * | 10/2004 | Pfeiffer et al. | 345/89 |
| 2009/0207162 | A1 | 8/2009 | Nakano et al. | |
| 2009/0310077 | A1 | 12/2009 | Kim et al. | |

(Continued)

FOREIGN PATENT DOCUMENTS

| | | |
|---|---|---|
| JP | 4049603 | 7/2007 |
| JP | 4559899 | 7/2010 |
| KR | 10-2008-0047881 | 5/2008 |

(Continued)

OTHER PUBLICATIONS

US Patent Application Publication 20130113770 (for KR10-2013-0049618).

(Continued)

*Primary Examiner* — Kent Chang
*Assistant Examiner* — Scott Au
(74) *Attorney, Agent, or Firm* — F. Chau & Associates, LLC

(57) ABSTRACT

A display device prevents breakage due to overheating of a data driver and a signal controller. The display device includes a display panel including a plurality of gate lines, a plurality of data lines and pixels connected to the gate lines and the data lines. A gate driver supplies a gate signal to the gate lines. A data driver supplies a data signal to the data lines. A signal controller controls the gate signal and the data signal. The signal controller includes a data converter converting a gray value of image data when a difference in the gray value of the image data of two adjacent pixels connected to the same data line among the plurality of data lines is greater than or equal to a first threshold value.

30 Claims, 15 Drawing Sheets

(56) References Cited

U.S. PATENT DOCUMENTS

| | | | | |
|---|---|---|---|---|
| 2010/0156954 | A1* | 6/2010 | Kim et al. | 345/690 |
| 2013/0113770 | A1 | 5/2013 | Kang et al. | |

FOREIGN PATENT DOCUMENTS

| | | |
|---|---|---|
| KR | 10-2008-0096907 | 11/2008 |
| KR | 10-2009-0000475 | 1/2009 |
| KR | 10-2011-0076642 | 7/2011 |
| KR | 10-2013-0049618 | 5/2013 |

OTHER PUBLICATIONS

English Abstract for Publication No. 4049603.
English Abstract for Publication No. 10-2008-0096907.
English Abstract for Publication No. 10-2008-0047881.
English Abstract for Publication No. 10-2009-0000475.
English Abstract for Publication No. 4559899.
English Abstract for Publication No. 10-2011-0076642.

* cited by examiner

DISPLAY DEVICE AND DRIVING METHOD THEREOF

CROSS-REFERENCE TO RELATED APPLICATION

This application claims priority to Korean Patent Application No. 10-2012-0054710, filed in the Korean Intellectual Property Office on May 23, 2012, the entire contents of which are incorporated herein by reference.

TECHNICAL FIELD

The present invention relates to a display device, and more particularly, to a display device and a driving method thereof.

DISCUSSION OF THE RELATED ART

Currently, display devices are extensively used in computer monitors, televisions, mobile phones and the like. Examples of display devices include cathode ray tubes, liquid crystal displays, plasma displays, organic light emitting diode (OLED) displays, etc.

The liquid crystal display (LCD) is currently one of the most widely used flat panel displays. The LCD generally includes two display panels on which field generating electrodes, such as a pixel electrode and a common electrode, are formed and a liquid crystal layer that is disposed therebetween. LCDs show an image by applying voltage to a field generating electrode to generate an electric field on a liquid crystal layer. The generated electric field determines an alignment of liquid crystal molecules of the liquid crystal layer and thereby controls polarization of incident light.

The liquid crystal display includes a display panel and a signal controller. The signal controller transfers image data of a screen to be displayed on the display panel and a control signal for driving the display panel to the display panel through a gate driver and a data driver, thus driving the display device.

A plurality of gate lines and a plurality of data lines are formed crossing each other on the display panel, and pixels connected to the gate lines and the data lines are formed. The gate lines are connected to the gate driver and receive the gate signal. The data lines are connected to the data driver and receive the data signal.

When data voltages applied to adjacent pixels of a plurality of pixels connected to the same data line are similar to each other, a swing width of the voltage controlled by the data driver is not large. On the other hand, when a difference in data voltages applied to the adjacent pixels is large, the swing width is increased, such that the temperature of the data driver may be increased.

The data driver may be damaged due to an increase in temperature of the data driver, and overheating may occur in the signal controller controlling the signal applied to the data driver.

SUMMARY OF THE INVENTION

Exemplary embodiments of the present invention provide a display device that is driven by determining whether a pattern of a pixel overheats a data driver. A data voltage is changed when there is a possibility of overheating.

Exemplary embodiments of the present invention provide a display device that can prevent breakage by preventing overheating of the data driver and the signal controller.

An exemplary embodiment of the present invention provides a display device including a display panel including a plurality of gate lines, a plurality of data lines and pixels connected to the gate lines and the data lines. A gate driver supplies a gate signal to the gate lines. A data driver supplies a data signal to the data lines. A signal controller controls the gate signal and the data signal. The signal controller includes a data converter converting a gray value of image data when a difference in the gray values of the image data of two adjacent pixels connected to the same data line among the plurality of data lines is greater than or equal to a first threshold value.

The data converter may includes a data comparator counting a number of cases where the difference in the gray value of the image data of two adjacent pixels connected to the same data line is greater or equal to the first threshold value and determining whether the number is greater or equal to a second threshold value. A gray value corrector converts the gray value of the image data when the number is greater or equal to the second threshold value.

The data comparator may determine, when the gray value of any one pixel of the two adjacent pixels is greater or equal to a threshold value h and the gray value of the other pixel is less than or equal to a threshold value l, and when the gray value of any one pixel of the two adjacent pixels is less than or equal to the threshold value l and the gray value of the other pixel is greater than or equal to the threshold value h, that the difference in the gray values of the image data of the two adjacent pixels is greater or equal to the first threshold value.

The gray value corrector may correct, when the number is greater than or equal to the second threshold value, the gray value of the image data having the gray value exceeding a third threshold value to the third threshold value.

The gray value corrector may sequentially reduce the gray values of the image data having the gray value exceeding the third threshold value during a plurality of frames correcting the gray value to the third threshold value.

The data comparator may count the number by comparing the gray values of the entire image data of one frame, and the gray value corrector may convert the gray value of the image data of the next frame when the number is greater or equal to the second threshold value.

There may be a plurality of data drivers, and the data comparator may count the number for a plurality of data drivers.

The gray value corrector may convert the gray value of the image data when the number in any one data driver of the plurality of data drivers is greater than or equal to the second threshold value.

The data comparator may count, when the pixels are disposed in a zigzag with respect to the data lines, the number of cases where the difference is greater than or equal to the first threshold value by comparing the differences in the gray values of the image data of two pixels adjacent in a diagonal direction.

The data converter may further include a data mapper re-disposing the pixels so that the image data of the two pixels adjacent in a diagonal direction are adjacent to each other in a data line direction when the pixels are disposed in a zigzag with respect to the data lines.

An exemplary embodiment of the present invention provides a driving method of a display device, including counting a number of cases where a difference in a gray value of image data of two adjacent pixels connected to the same data line among a plurality of data lines is greater than or equal to a first threshold value, It is determined whether the number is greater than or equal to a second threshold value. The gray value of the image data is converted when the number is greater than or equal to the second threshold value. The converted image data is output.

The gray value of the image data might not be converted and the image data may be outputted when the number is less than the second threshold value.

In the counting of the number of cases where the difference in the gray value of image data of the two adjacent pixels is greater than or equal to a first threshold value, when the gray value of any one pixel of the two adjacent pixels is greater or equal to the threshold value h and the gray value of the other pixel is less than or equal to the threshold value l, and when the gray value of any one pixel of the two adjacent pixels is less than or equal to the threshold value l and the gray value of the other pixel is greater than or equal to the threshold value h, the determination that the difference in the gray values of the image data of the two adjacent pixels is greater than or equal to the first threshold value may be performed.

In converting the gray value of the image data, when the number is greater than or equal to the second threshold value, the gray values of the image data exceeding a third threshold value may be corrected to the third threshold value.

In converting the gray value of the image data, the gray values of the image data exceeding the third threshold value may be sequentially reduced during a plurality of frames to correct the gray values to the third threshold value.

In the counting of the number of cases where the difference in the gray values of image data of the two adjacent pixels is greater than or equal to the first threshold value, the number may be counted by comparing the gray values of the entire image data of one frame. In converting the gray values of the image data, the gray values of the image data of the next frame may be converted when the number is greater than or equal to the second threshold value.

The plurality of data lines may be separately connected to a plurality of data drivers, and in the counting of the number of cases where the difference in the gray values of image data of the two adjacent pixels is greater than or equal to the first threshold value, the number may be counted for the plurality of data drivers.

In converting the gray value of the image data, the gray value of the image data may be converted when the number in any one data driver of the plurality of data drivers is greater than or equal to the second threshold value.

The display device may include a plurality of pixels connected to the data lines, and in counting the number of cases where the difference in the gray values of image data of the two adjacent pixels is greater than or equal to the first threshold value, and when the plurality of pixels are disposed in a zigzag with respect to the data lines, the number of cases where the difference is greater than or equal to the first threshold value may be counted by comparing the differences in the gray values of the image data of the two pixels adjacent in a diagonal direction.

The display device may include a plurality of pixels connected to the data lines, and before counting the number of cases where the difference in the gray values of image data of the two adjacent pixels is greater than or equal to the first threshold value, the driving method may further include redisposing the pixels so that the image data of the two pixels adjacent in a diagonal direction are adjacent to each other in a data line direction when the plurality of pixels are disposed in a zigzag with respect to the data lines.

The aforementioned display device and driving method thereof may have the following effects.

In a display device and a driving method thereof according to an exemplary embodiments of the present invention, the display device is driven by determining whether a pattern of a pixel overheats a data driver and reducing a difference in gray values of adjacent pixels when there is a possibility of overheating, such that there is an effect preventing overheating of the data driver and the signal controller.

Further, there is an effect of preventing breakage due to overheating of the data driver and the signal controller.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE EMBODIMENTS

Figure 1:
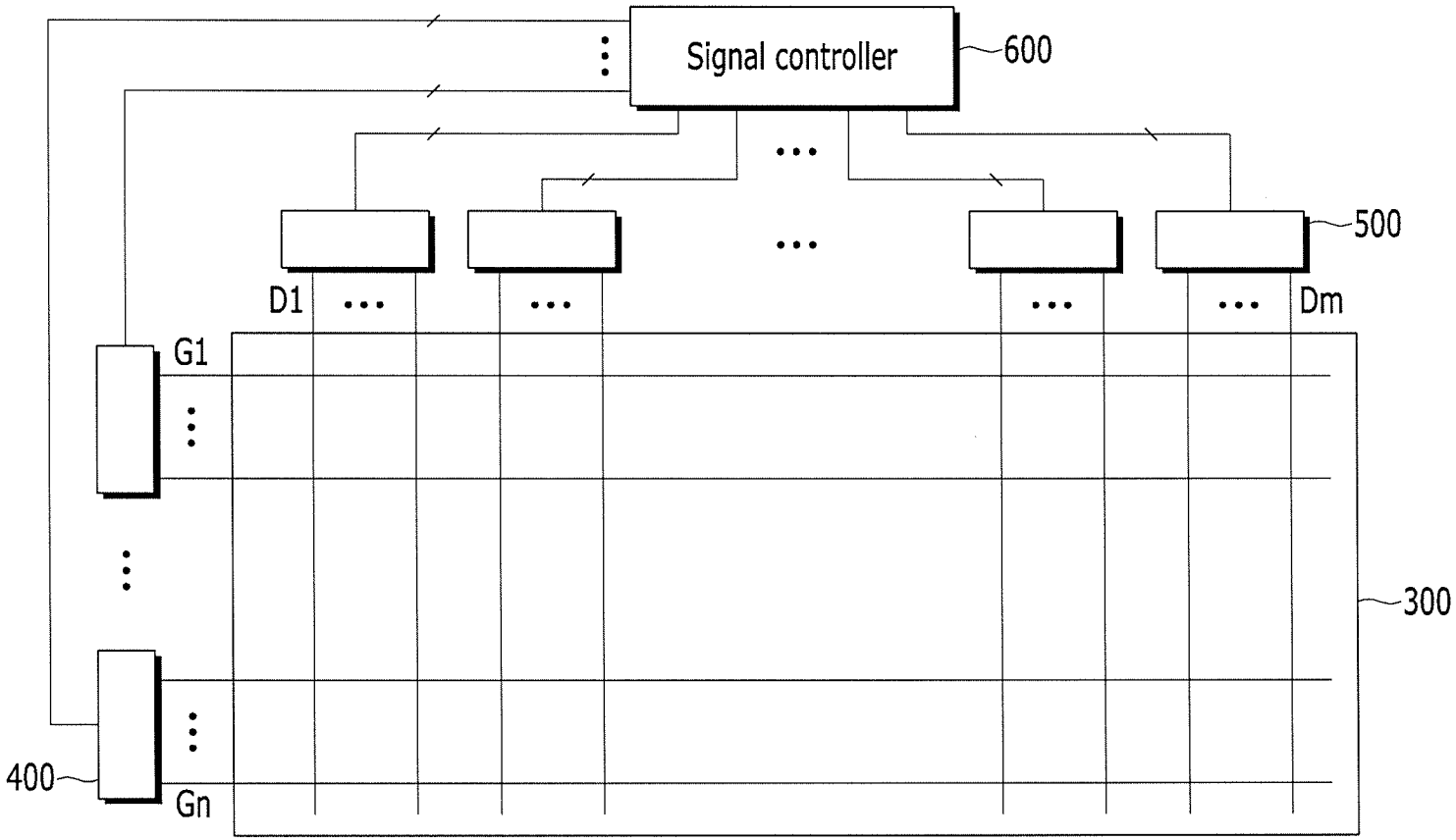
FIG. 1 is a block diagram of a display device according an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., may be exaggerated for clarity. Like reference numerals may designate like elements throughout the specification. It will be understood that when an element such as a layer, film, region, or substrate is referred to as being "on" another element, it may be directly on the other element or intervening elements may also be present.

First, a display device according to an exemplary embodiment of the present invention will be described referring to the accompanying drawings.

Figure 2:
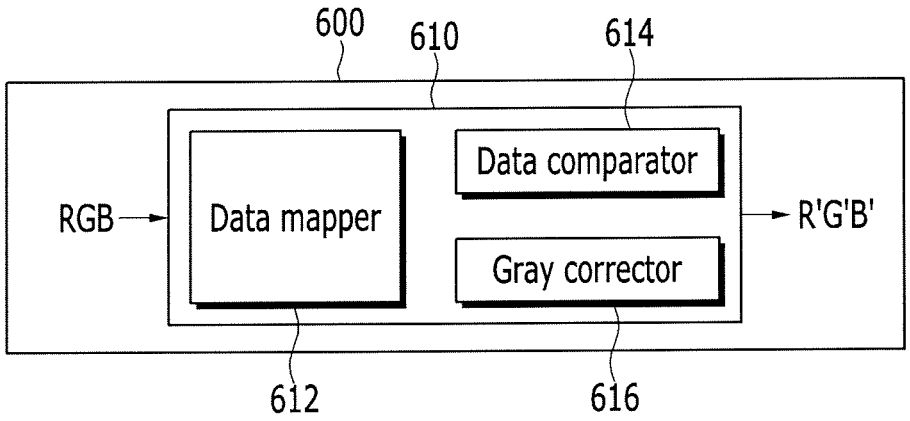
FIG. 2 is a block diagram showing a signal controller of the display device according to an exemplary embodiment of the present invention.

FIG. 1 is a block diagram of a display device according an exemplary embodiment of the present invention and FIG. 2 is a block diagram showing a signal controller of the display device according to an exemplary embodiment of the present invention.

The display device according to an exemplary embodiment of the present invention may include a display panel 300 including a plurality of pixels, a signal controller 600 controlling signals to drive the display panel, and a gate driver 400 and a data driver 500 applying signals to drive the display panel 300.

The display panel 300 includes a plurality of gate lines (G1-Gn) and a plurality of data lines (D1-Dm), the plurality of gate lines (G1-Gn) extends in a horizontal direction, and the plurality of data lines (D1-Dm) crosses the plurality of gate lines (G1-Gn) and extends in a vertical direction.

The display panel 300 includes pixels (PX) connected to the gate lines (G1-Gn) and the data lines (D1-Dm), and each pixel (PX) includes a switching element connected to the gate lines (G1-Gn) and the data lines (D1-Dm). A control terminal of the switching element is connected to the gate lines (G1-Gn), an input terminal is connected to the data lines (D1-Dm), and an output terminal is connected to a liquid crystal capacitor and a maintenance capacitor.

The display panel 300 includes a first substrate on which the gate lines (G1-Gn), the data lines (D1-Dm), the pixels (PX), the switching element and the like are formed, a second substrate facing the first substrate, and a liquid crystal layer interposed between the first substrate and the second substrate.

The aforementioned description provides that the display panel 300 includes liquid crystal panels, but the present invention is not limited thereto, and various display panels such as an organic light emitting panel, an electrophoresis display panel, and a plasma display panel may be used.

The signal controller 600 controls the gate driver 400, the data driver 500, and the like. The signal controller 600 receives image data and a control signal controlling display thereof from an external graphic controller (not shown). The image data includes luminance information of each pixel (PX), and the luminance has a gray value having a predetermined number, for example, $1024=2^{10}$, $256=2^{8}$ or $64=2^{6}$. Examples of the control signal include a vertical synchronization signal (Vsync), a horizontal synchronization signal (Hsync), a main clock signal (MCLK), a data enable signal (DE), and the like.

The signal controller 600 appropriately treats the image data according to an operating condition of the display panel 300 based on the control signal, generates a gate control signal (CONT1), a data control signal (CONT2) and the like, and then outputs the gate control signal (CONT1) to the gate driver 400 and outputs the data control signal (CONT2) and the treated image data to the data driver 500.

The gate driver 400 is connected to the gate lines (G1-Gn) of the display panel 300, and applies the gate signal that is formed by the combination of a gate-on voltage (Von) and a gate-off voltage (Voff) to the gate lines (G1-Gn).

The data driver 500 is connected to the data lines (D1-Dm) of the display panel 300, and applies a voltage corresponding to the gray value of the image data applied from the signal controller 600 as a data voltage to the data lines (D1-Dm). The data driver 500 may determine a gamma voltage corresponding to the gray value of the corresponding image data.

The driving devices 400, 500, and 600 may each be mounted on the display panel 300 in at least one IC chip, may be mounted on a flexible printed circuit film (not shown) to be attached to a liquid crystal panel assembly 300 in a TCP (tape carrier package) form, or may be mounted on a separate printed circuit board (PCB) (not shown). These driving devices 400, 500, and 600, may be integrated together with the signal lines ($G_1$-$G_n$, $D_1$-$D_m$) and the switching element on the display panel 300. Further, the driving devices 400, 500, and 600 may be integrated in a single chip, and in this case, at least one of the devices or at least one circuit diode constituting the devices may be provided outside the single chip.

Referring to FIG. 2, the signal controller 600 includes a data converter 610 determining whether the pixel pattern of the corresponding frame is a pattern that may cause overheating of the data driver 500 and converting the gray value of the image data.

The data converter 610 includes a data comparator 614 counting the number of cases where a difference between gray values of image data (RGB) of two adjacent pixels (PX) connected to the same data line ($D_1$-$D_m$) of a plurality of data lines ($D_1$-$D_m$) is greater than or equal to a first threshold value and determining whether the number is greater than or equal to a second threshold value. A gray value corrector 616 converts the gray value of the image data (RGB) when the number is greater than or equal to the second threshold value.

For example, when the image data (RGB) applied to the data converter 610 are compared and determined, in the data comparator 614, to satisfy a predetermined condition, the gray value corrector 616 converts the gray value of the image data (RGB) and outputs the converted image data (R'G'B').

The data comparator 614 has a threshold value including a threshold value h and a threshold value l. In the display device formed of 256 gray values, the threshold value h may be set to a value that is close to 256 gray value and the threshold value l may be set to a value that is close to 0 gray value.

The data comparator 614 determines that the difference between gray values of the image data (RGB) of the two adjacent pixels (PX) is greater than or equal to the first threshold value when the gray value of any one pixel of the two adjacent pixels is greater than or equal to the threshold value h and the gray value of the other pixel is less than or equal to the threshold value l. Further, the data comparator determines that the difference between gray values of the image data (RGB) of the two adjacent pixels (PX) is greater than or equal to the first threshold value when the gray value of any one pixel of the two adjacent pixels is less than or equal to the threshold value l and the gray value of the other pixel is greater than or equal to the threshold value h.

For example, the data comparator 614 determines that the difference between gray values of two pixels is large when any one pixel of the two adjacent pixels has a value that is close to the minimum gray value and the other pixel has a value that is close to the maximum gray value.

The data comparator 614 compares the gray values of the entire image data of one frame to count the number of cases where the difference between gray values of the image data (RGB) of two adjacent pixels (PX) is greater than or equal to the first threshold value.

As the comparison and determination results of the data comparator 614, when the number of cases where the difference between gray values of the image data (RGB) of two adjacent pixels (PX) is greater than or equal to the first threshold value is less than the second threshold value, the gray value corrector 616 does not correct the gray value of the image data (RGB). The data comparator 614 outputs the image data (R'G'B') converted by converting the image data (RGB) by the gray value corrector 616 when the number of cases where the difference between gray values of the image data (RGB) of two adjacent pixels (PX) is greater than or equal to the first threshold value is greater than or equal to the second threshold value.

For example, the first threshold value, the threshold value h, the threshold value l and the second threshold value may be appropriately set in consideration of the degree of effect to the data driver 500. For example, the first threshold value may be set to 220 gray value, the threshold value h may be 20 gray value, the threshold value l may be 240 gray value, and the second threshold value may be set to 50.

The data comparator 614 compares the gray values of the entire image data of one frame to count the number of cases where the difference between gray values of the image data (RGB) of two adjacent pixels (PX) is greater than or equal to the first threshold value.

The gray value corrector 616 corrects the gray value of the image data having the gray value exceeding the third threshold value to the third threshold value. The third threshold value may be set so that a change in gray value is not visible. For example, the third threshold value may be set to 250 gray value.

The gray value corrector 616 may immediately correct the gray value of the image data having the gray value exceeding the third threshold value to the third threshold value in the next frame when the number of cases where the gray value is greater than or equal to the first threshold value is greater than or equal to the second threshold value.

The gray value corrector 616 may sequentially perform correction of the gray value. For example, the gray value corrector 616 may sequentially reduce the gray values of the image data having the gray value exceeding the third threshold value during a plurality of frames to correct the gray value to the third threshold value.

As shown in FIG. 1, a plurality of data driver 500 may be formed. In this case, the data comparator 614 may count the number for a plurality of data drivers 500. Further, the gray value corrector 616 may convert the gray value of the image data (RGB) if the number in any one data driver 500 of the plurality of data drivers 500 is greater than or equal to the second threshold value.

The data converter 610 may further include a data mapper 612. The data mapper 612 may re-dispose the image data.

When a plurality of pixels (PX) connected to the same data line ($D_1$-$D_m$) are disposed in the same direction, the data comparator 614 may compare the differences in gray values of the adjacent pixels disposed on the same row. When a plurality of pixels (PX) connected to the same data line are disposed in a zigzag, the data comparator 614 compares the differences in gray values of the adjacent pixels in a diagonal direction.

The data mapper 612 may re-dispose the image data so that the data comparator 614 compares the differences in gray values of the adjacent pixels disposed on the same row. For example, when the pixels (PX) are disposed in a zigzag with respect to the data lines ($D_1$-$D_m$), the data mapper 612 re-dispose the image data so that the image data of two pixels (PX) that are adjacent in the diagonal direction are adjacent to each other in a data line ($D_1$-$D_m$) direction.

Hereinafter, a driving method of the display device according to an exemplary embodiment of the present invention will be described referring to the drawings.

Figure 3:
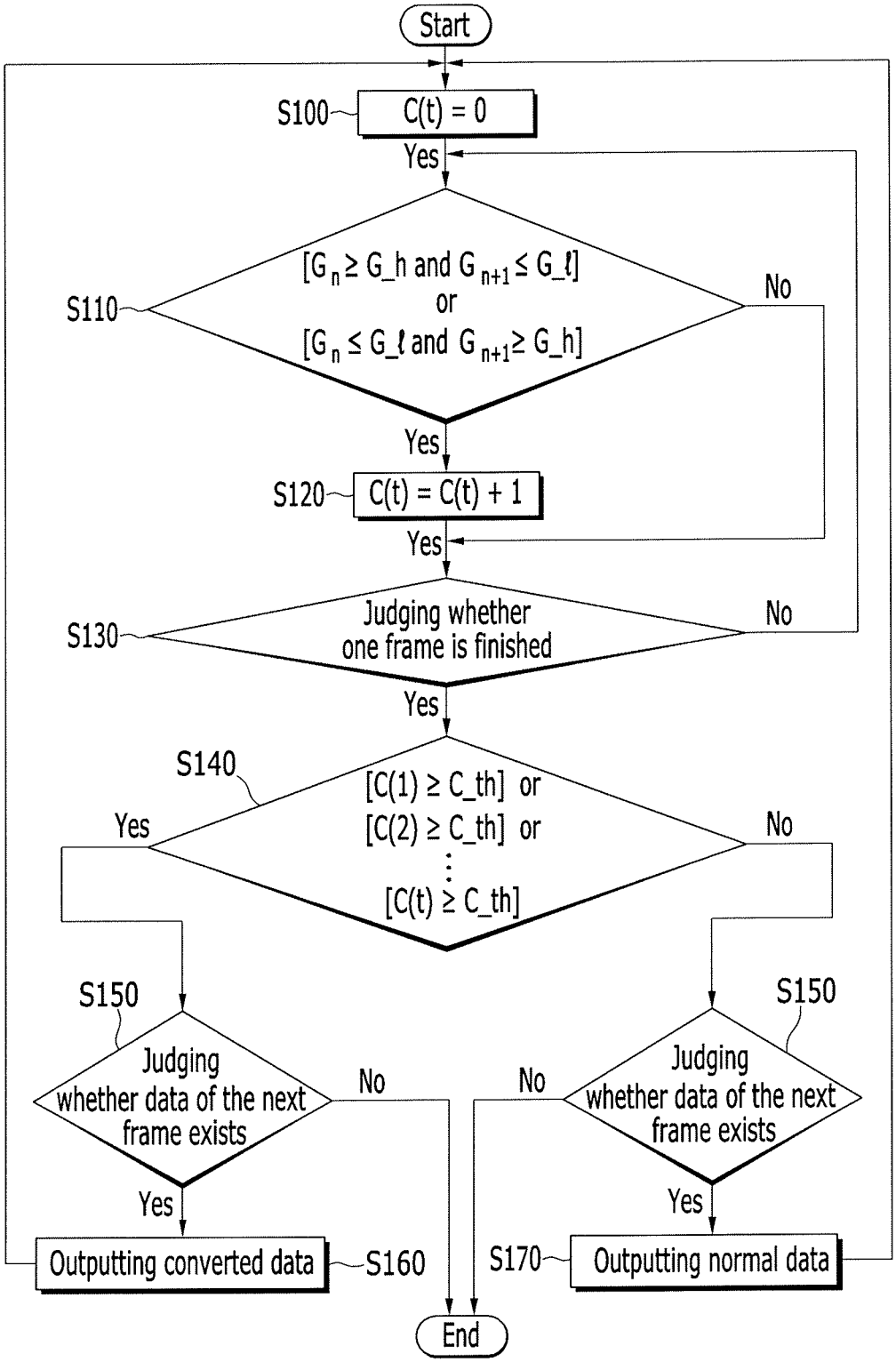
FIG. 3 is a flowchart showing a driving method of the display device according to an exemplary embodiment of the present invention.
Figure 4:
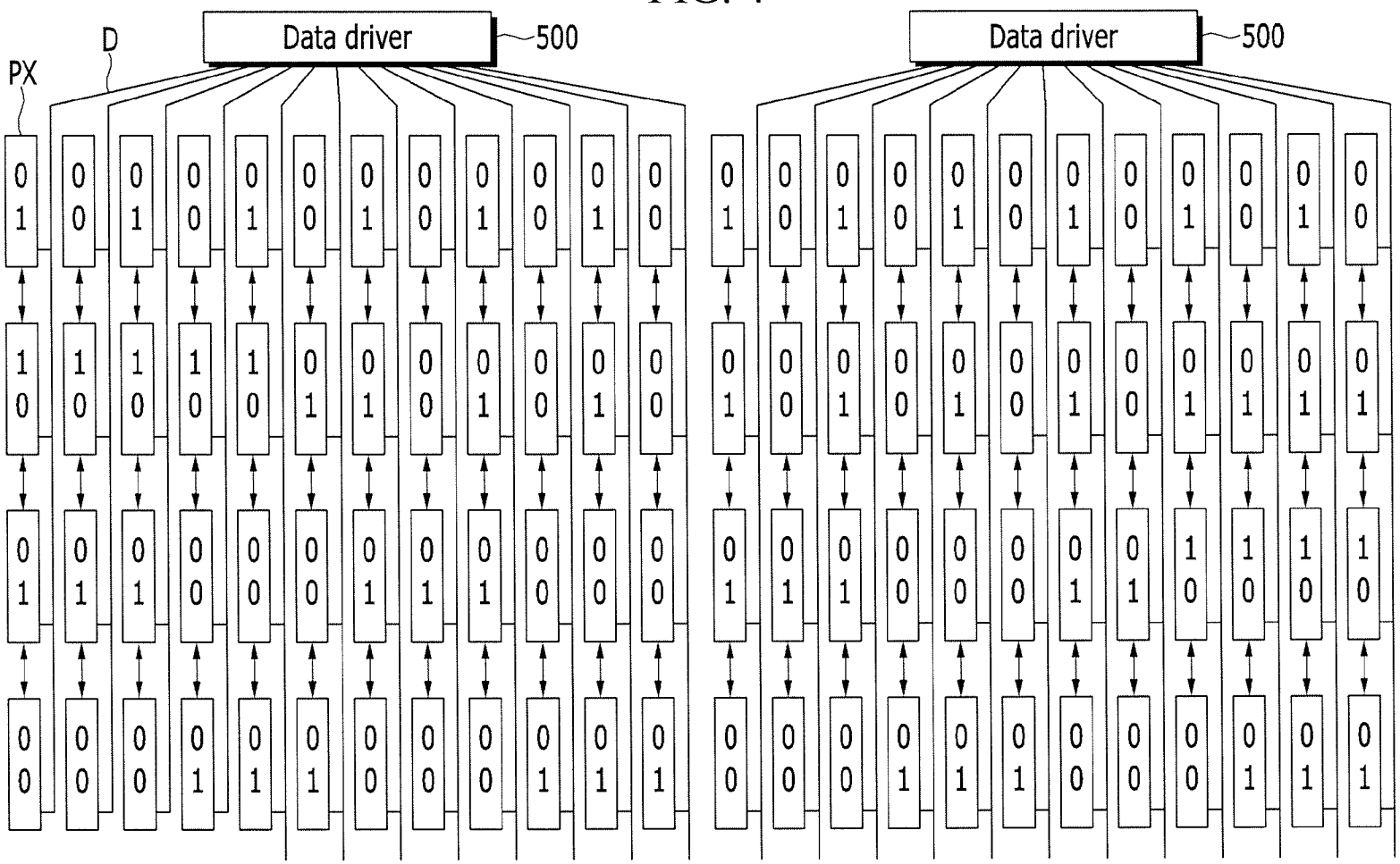
FIG. 4 is a view showing a comparison result of a gray value, a threshold value h and a threshold value l of each pixel in the display device according to an exemplary embodiment of the present invention.

FIG. 3 is a flowchart showing a driving method of the display device according to an exemplary embodiment of the present invention. FIG. 4 is a view showing a comparison result of a gray value and threshold values of each pixel in the display device according to an exemplary embodiment of the present invention.

As shown in FIG. 3, first, C(t) representing the number of cases where the difference in gray value of the image data of two adjacent pixels connected to the same data line is greater than or equal to the first threshold value is reset to 0 (Step S100).

Herein, t represents the order of data drivers, the number of cases where the difference in gray value of the adjacent pixels in the first data driver is greater than or equal to the first threshold value is represented by C(1), and the number of cases where the difference in gray value of the adjacent pixels in the t-th data driver is greater than or equal to the first threshold value is represented by C(t).

Subsequently, the gray value of each pixel is compared to the threshold value h (G_h) and the threshold value l (G_l) (Step S110). It is determined whether a gray value ($G_n$) of a n-th pixel is greater than or equal to the threshold value h (G_h) and a gray value ($G_{n+1}$) of a n+1-th pixel of adjacent pixels connected to the same data line as the n-th pixel is less than or equal to the threshold value l (G_l). Further, it is determined whether the gray value (Gn) of the n-th pixel is less than or equal to the threshold value l (G_l) and the gray value (Gn+1) of the n+1-th pixel is greater than or equal to the threshold value h (G_h). If the determination result corresponds to any one of the two cases, a new C(t) is formed by adding one to the known C(t) (Step S120).

For example, the number of cases where any one pixel of the adjacent pixels connected to the same data line is greater than or equal to the threshold value h (G_h) and the other pixel is less than or equal to the threshold value l (G_l) is counted.

Subsequently, it is determined whether one frame is finished, and if the frame is not finished, steps S110 and S120 are repeated (Step S130). For example, the number is counted by comparing the gray values of the entire image data of one frame by the same method.

Hereinafter, referring to FIG. 4, a method of counting the number of cases where any one pixel of the adjacent pixels connected to the same data line (D) is greater than or equal to the threshold value h (G_h) and the other pixel is less than or equal to the threshold value l (G_l) will be described as an example.

The display device shown in FIG. 4 includes two data drivers 500, one data driver 500 is connected to twelve data lines (D), and four pixels (PX) are connected to one data line (D).

The number of data drivers 500, data lines (D) and pixels (PX) illustrated is an example selected for description, and the number may be changed according to resolution of the display device. For example, the data driver 500 may be connected to various numbers, such as 366, 414, 576, 720, 960 and 1026, of data lines (D).

First, the pixel (PX) connected to the data line (D) receiving the signal from the first data driver 500 will be described. The case where the gray value of the corresponding pixel (PX) is higher than the threshold value h (G_h) is represented by 01, the case where the gray value is lower than the threshold value l (G_l) is represented by 00, and the case where the gray value is between the threshold value h (G_h) and the threshold value l (G_l) is represented by 10.

Since the first pixel (PX) connected to the first data line (D) has the gray value that is higher than the threshold value h (G_h) and the second pixel (PX) has the gray value between the threshold value h (G_h) and the threshold value l (G_l), C(1) is maintained at 0. Since the first pixel (PX) connected to the second data line (D) has the gray value that is lower than the threshold value l (G_l) and the second pixel (PX) has the gray value between the threshold value h (G_h) and the threshold value l (G_l), C(1) is maintained at 0. C(1) is maintained at 0 during the comparison process of the first pixel (PX) and the second pixel (PX) connected to the third to fifth data lines (D).

Since the first pixel (PX) connected to the sixth data line (D) has the gray value that is lower than the threshold value l (G_l) and the second pixel (PX) has the gray value that is higher than the threshold value h (G_h), C(1) is changed to 1.

Since the first pixel (PX) connected to the seventh data line (D) has the gray value that is higher than the threshold value h (G_h) and the second pixel (PX) has the gray value that is higher than the threshold value h (G_h), C(1) is maintained at 1. Since the first pixel (PX) connected to the eighth data line (D) has the gray value that is lower than the threshold value l (G_l) and the second pixel (PX) has the gray value that is lower than the threshold value l (G_l), C(1) is maintained at 1. Since the first pixel (PX) connected to the ninth data line (D) has the gray value that is higher than the threshold value h (G_h) and the second pixel (PX) has the gray value that is higher than the threshold value h (G_h), C(1) is maintained at 1. Since the first pixel (PX) connected to the tenth data line (D) has the gray value that is lower than the threshold value l (G_l) and the second pixel (PX) has the gray value that is lower than the threshold value l (G_l), C(1) is maintained at 1.

C(1) is maintained at 1 during the comparison process of the first pixel (PX) and the second pixel (PX) connected to the eleventh to twelfth data lines (D).

Subsequently, the second pixel (PX) and the third pixel (PX) connected to the data lines (D) connected to the first data driver 500 are compared to the threshold value h (G_h) and the threshold value l (G_l), respectively, to maintain or change C(1). Since the second pixel (PX) connected to the sixth data line (D) has the gray value that is higher than the threshold value h (G_h) and the third pixel (PX) has the gray value that is lower than the threshold value l (G_l), C(1) is changed to 2. Since the second pixel (PX) connected to the eighth data line (D) has the gray value that is lower than the threshold value l (G_l) and the third pixel (PX) has the gray value that is higher than the threshold value h (G_h), C(1) is changed to 3. Since the second pixel (PX) connected to the eleventh data line (D) has the gray value that is higher than the threshold value h (G_h) and the third pixel (PX) has the gray value that is lower than the threshold value l (G_l), C(1) is changed to 4.

Subsequently, the third pixel (PX) and the fourth pixel (PX) connected to the data lines (D) connected to the first data driver 500 are compared to the threshold value h (G_h) and the threshold value l (G_l), respectively, to maintain or change C(1). The third pixel (PX) connected to the first, second, third, seventh, eighth and ninth data lines (D) has the gray value that is higher than the threshold value h (G_h) and the fourth pixel (PX) has the gray value that is lower than the threshold value l (G_l). Further, the third pixel (PX) connected to the fourth, fifth, sixth, tenth, eleventh and twelfth data lines (D) has the gray value that is lower than the threshold value l (G_l) and the fourth pixel (PX) has the gray value that is higher than the threshold value h (G_h). Accordingly, C(1) is changed to 16.

Next, the pixel (PX) connected to the data line (D) receiving the signal from the second data driver 500 will be described.

The first pixel (PX) and the second pixel (PX) connected to the data lines (D) connected to the second data driver 500 are compared to the threshold value h (G_h) and the threshold value l (G_l), respectively, to change C(2) from 0 to 2.

Subsequently, the second pixel (PX) and the third pixel (PX) connected to the data lines (D) connected to the second data driver 500 are compared to the threshold value h (G_h) and the threshold value l (G_l), respectively, to change C(2) from 2 to 5.

Subsequently, the third pixel (PX) and the fourth pixel (PX) connected to the data lines (D) connected to the second data driver 500 are compared to the threshold value h (G_h) and the threshold value l (G_l), respectively, to change C(2) from 5 to 13.

In the display device shown in FIG. 4, the gray values of all pixels of one frame are examined for each data driver 500, and as a result, C(1) is 16 and C(2) is 13.

Next, referring to FIG. 5, when the pixels are disposed in a zigzag based on the data line (D), a method of counting the number of cases where any one pixel of the adjacent pixels connected to the same data line (D) is greater than or equal to the threshold value h (G_h) and the other pixel is less than or equal to the threshold value l (G_l) will be described as an example.

Figure 5:
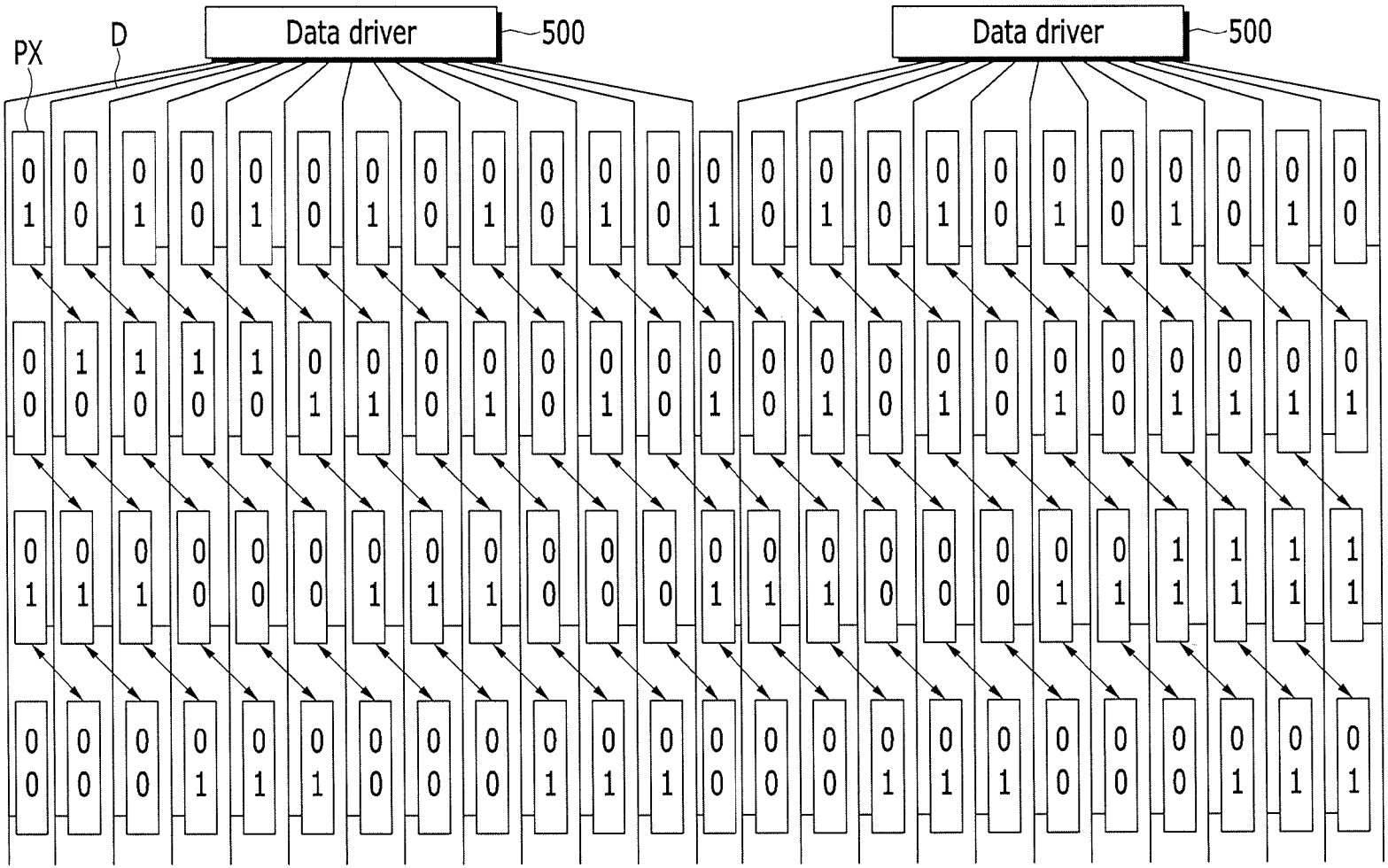
FIG. 5 is a view showing a comparison result of the gray value, the threshold value h and the threshold value l of each pixel in the display device according to an exemplary embodiment of the present invention.

FIG. 5 is a view showing a comparison result of the gray value, the threshold value h and the threshold value l of each pixel in the display device according to an exemplary embodiment of the present invention.

The display device shown in FIG. 5 includes two data drivers 500, each data driver 500 is connected to a plurality of data lines (D), and a plurality of pixels (PX) is connected to each data line (D).

First, the pixel (PX) connected to the data line (D) receiving the signal from the first data driver 500 will be described. Since the number of pixels connected to the first data line (D) is 2, the pixel connected to the second data line (D) will be first described.

Since the first pixel (PX) connected to the second data line (D) has the gray value that is higher than the threshold value h (G_h) and the second pixel (PX) has the gray value between the threshold value h (G_h) and the threshold value l (G_l), C(1) is maintained at 0. The first pixel (PX) and the second pixel (PX) connected to the third to thirteenth data lines (D) are compared to the threshold value h (G_h) and the threshold value l (G_l), respectively, by the same method to change C(1) from 0 to 7.

Subsequently, the second pixel (PX) and the third pixel (PX) connected to the data lines (D) connected to the first data driver 500 are compared to the threshold value h (G_h) and the threshold value l (G_l), respectively, to change C(1) from 7 to 14.

Subsequently, the third pixel (PX) and the fourth pixel (PX) connected to the data lines (D) connected to the first data driver 500 are compared to the threshold value h (G_h) and the threshold value l (G_l), respectively, to change C(1) from 14 to 23.

Next, the pixel (PX) connected to the data line (D) receiving the signal from the second data driver 500 will be described.

The first pixel (PX) and the second pixel (PX) connected to the data lines (D) connected to the second data driver 500 are compared to the threshold value h (G_h) and the threshold value l (G_l), respectively, to change C(2) from 0 to 11.

Subsequently, the second pixel (PX) and the third pixel (PX) connected to the data lines (D) connected to the second data driver 500 are compared to the threshold value h (G_h) and the threshold value l (G_l), respectively, to change C(2) from 11 to 15.

Subsequently, the third pixel (PX) and the fourth pixel (PX) connected to the data lines (D) connected to the second data driver 500 are compared to the threshold value h (G_h) and the threshold value l (G_l), respectively, to change C(2) from 15 to 19.

In the display device shown in FIG. 4, since all pixels (PX) are disposed in the same direction based on the data line (D), the gray values of the pixels disposed on the same row may be compared in order to compare the gray values of the adjacent pixels connected to the same data line (D). In the display device shown in FIG. 5, since the pixels (PX) are disposed in a zigzag based on the data line (D), the gray values of the pixels adjacent in a diagonal direction are compared in order to compare the gray values of the adjacent pixels connected to the same data line (D).

Accordingly, even when the pixels (PX) are disposed in a zigzag based on the data line (D), like the case where the pixels are disposed in the same direction, the image data may be re-disposed in order to compare the gray values of the pixels disposed on the same row. For example, before the number of cases where the difference in gray value of the image data of the adjacent pixels is greater than or equal to the first threshold value is counted, when the pixels (PX) are disposed in a zigzag based on the data line (D), the image data of two pixels (PX) adjacent in a diagonal direction may be re-disposed so as to be adjacent to each other in a data line (D) direction.

Referring to FIG. 3 again, after the gray values of all pixels of one frame are compared and determined, C(t) with respect to each data driver is compared to the second threshold value (C_th) (Step S140).

Whether C(1) is greater than or equal to the second threshold value (C_th), whether C(2) is greater than or equal to the second threshold value (C_th), and whether C(t) is greater than or equal to the second threshold value (C_th) are determined.

When any one of C(1) to C(t) is greater than or equal to the second threshold value (C_th), the gray value of the image data of the next frame is converted and outputted (Step S160). When all of C(1) to C(t) are less than the second threshold value (C_th), the gray value of the image data of the next frame is not converted and normal data are outputted (Step S170).

For example, in the display device shown in FIG. 4, when the second threshold value (C_th) is set to 14, C(1) is 16, which corresponds to the case where C(t) with respect to any one data driver 500 of two data drivers 500 is greater than or equal to the second threshold value (C_th), such that the gray value of the image data of the next frame is converted and outputted.

Further, in the display device shown in FIG. 5, C(1) is 23 and C(2) is 19, which correspond to the case where all C(t) with respect to two data drivers 500 are greater than or equal to the second threshold value (C_th), such that the gray value of the image data of the next frame is converted and outputted.

In the above, converting the gray value of the image data when any one of C(t)s with respect to a plurality of data drivers is greater than or equal to the second threshold value (C_th) is described, but the present invention is not limited thereto and another setting can be performed. For example, converting the gray value of the image data may be set when 30% or more of C(t) with respect to a plurality of data drivers are greater than or equal to the second threshold value (C_th).

As described above, when there is the image data of the next frame, converted data or normal data are outputted, C(t) is reset to 0, and steps S110 to S150 are then repeated. On the other hand, when there is no image data of the next frame, the process is finished (No, Step S150).

Hereinafter, a method of generating the image data converted by correcting the gray value of the image data will be described.

As a result of comparison and determination of the image data of a f-th frame, when the number of cases where the difference in gray value of the image data of the two adjacent pixels connected to the same data line is greater than or equal to the first threshold value is greater than or equal to the second threshold value, the image data of a (f+1)-th frame is converted.

The gray value of the image data having the gray value exceeding the third threshold value among the image data of the (f+1)-th frame may be corrected to the third threshold value.

Subsequently, if comparison and determination results of the image data of (f+1)-th and (f+2)-th frames are the same as that of the f-th frame, the converted image data are continuously outputted.

As a result of comparison and determination of the image data of a (f+3)-th frame, if the number of cases where the difference in gray value of the image data of the two adjacent pixels connected to the same data line is greater than or equal to the first threshold value is less than the second threshold value, the image data of a (f+4)-th frame are not converted and normal data are outputted.

Subsequently, if comparison and determination results of the image data of (f+4)-th and (f+5)-th frames are the same as that of the (f+3)-th frame, normal data are continuously outputted.

An example will be described referring to Table 1. The third threshold value is set to 250.

TABLE 1

| Frame number | Gray value before correction | Gray value after correction |
|---|---|---|
| f | 0-255 | 0-255 |
| f + 1 | 0-250/251-255 | 0-250/250 |
| f + 2 | 0-250/251-255 | 0-250/250 |
| f + 3 | 0-250/251-255 | 0-250/250 |
| f + 4 | 0-255 | 0-255 |
| f + 5 | 0-255 | 0-255 |
| f + 6 | 0-255 | 0-255 |

First, when the number of cases where the difference in gray value of the adjacent pixels in the f-th frame is greater than or equal to the first threshold value is greater than or equal to the second threshold value, the image data having 0 to 255 gray value are not converted and outputted of itself. In the (f+1)-th, (f+2)-th and (f+3)-th frames, the image data having 251 to 255 gray value are converted to 250 gray value and outputted.

First, when the number of cases where the difference in gray value of the adjacent pixels in the (f+3)-th frame is greater than or equal to the first threshold value is greater than or equal to the second threshold value, the image data having 0 to 255 gray value are not converted and outputted of itself in the (f+4)-th frame. Subsequently, normal data are outputted even in (f+5)-th and (f+6)-th frames.

The image data having 0 to 250 gray value are not converted in all frames, and normal data are outputted.

In the above, the correcting of the gray value of the image data having the gray value exceeding the third threshold value in the next frame to the third threshold value when the number of cases where the difference in gray value of the adjacent pixels is greater than or equal to the first threshold value is greater than or equal to the second threshold value is described, but the present invention is not limited thereto, and the image data may be converted by another method.

Hereinafter, a method of generating the image data converted by correcting the gray value of the image data will be described.

In the above, converting the image data of the next frame is determined by comparing and determining the differences in gray value of the adjacent pixels, but in another method to be described hereinafter, the gray value of the image data having the gray value exceeding the third threshold value may be corrected to the third threshold value by being sequentially reduced during a plurality of frames.

When the number of cases where the difference in gray value of the adjacent pixels in the f-th frame is greater than or equal to the first threshold value is greater than or equal to the second threshold value, the gray value of the image data having the gray value exceeding the third threshold value is corrected to the third threshold value by being sequentially reduced during five frames formed of the (f+1)-th frame to the (f+5)-th frame.

If the number of cases where the difference in gray value of the adjacent pixels is greater than or equal to the first threshold value between the (f+1)-th frame and the (f+5)-th frame is less than the second threshold value, the process of reducing the gray value of the image data having the gray value exceeding the third threshold value is stopped and sequential correction to normal data is performed.

When the number of cases where the difference in gray value of the adjacent pixels in the (f+6)-th frame is greater than or equal to the first threshold value is less than the second threshold value, the gray value of the image data having the gray value exceeding the third threshold value is sequentially corrected from converted data to normal data during five frames formed of the (f+7)-th frame to the (f+11)-th frame.

If the number of cases where the difference in gray value of the adjacent pixels between the (f+7)-th frame and the (f+11)-th frame is greater than or equal to the first threshold value is greater than or equal to the second threshold value, the correction process to normal data is stopped and converting the image data is sequentially performed.

An example will be described below referring to Table 2. The third threshold value is set to 250, and converting the image data is set so that one gray value is corrected for one frame.

TABLE 2

| Frame number | Gray value before correction | Gray value after correction |
|---|---|---|
| f | 0-255 | 0-255 |
| f + 1 | 0-254/255 | 0-254/254 |
| f + 2 | 0-253/254-255 | 0-253/253 |
| f + 3 | 0-252/253-255 | 0-252/252 |
| f + 4 | 0-251/252-255 | 0-251/251 |
| f + 5 | 0-250/251-255 | 0-250/250 |
| f + 6 | 0-250/251-255 | 0-250/250 |
| f + 7 | 0-251/252-255 | 0-251/251 |
| f + 8 | 0-252/253-255 | 0-252/252 |
| f + 9 | 0-253/254-255 | 0-253/253 |
| f + 10 | 0-254/255 | 0-254/254 |
| f + 11 | 0-255 | 0-255 |

First, when the number of cases where the difference in gray value of the adjacent pixels in the f-th frame is greater than or equal to the first threshold value is greater than or equal to the second threshold value, the image data having 0 to 255 gray values are not converted and outputted of itself. In the (f+1)-th frame, the image data having the 255 gray values are converted to 254 gray values and outputted. In this case, the image data having 0 to 254 gray values are not converted and normal data are outputted. In the (f+2)-th frame, the image data having 254 to 255 gray values are converted to 253 gray values and outputted. In this case, the image data having 0 to 253 gray values are not converted and normal data are outputted. In the (f+3)-th frame, the image data having 253 to 255 gray values are converted to 252 gray values and outputted. In this case, the image data having 0 to 252 gray values are not converted and normal data are outputted. In the (f+4)-th frame, the image data having 252 to 255 gray values are converted to 251 gray values and outputted. In this case, the image data having 0 to 251 gray values are not converted and normal data are outputted. In the (f+5)-th frame, the image data having 251 to 255 gray values are converted to 250 gray values and outputted. In this case, the image data having 0 to 250 gray values are not converted and normal data are outputted.

When the number of cases where the difference in gray value of the adjacent pixels is continuously greater than or equal to the first threshold value in the (f+1)-th frame to the (f+4)-th frame is greater than or equal to the second threshold value, the aforementioned manner may be performed. If the number of cases where the difference in gray value of the adjacent pixels is greater than or equal to the first threshold value between the (f+1)-th frame and the (f+4)-th frame is less than the second threshold value, the sequential converting the image data is stopped and a recovering process for outputting normal data is performed.

First, when the number of cases where the difference in gray value of the adjacent pixels in the (f+6)-th frame is greater than or equal to the first threshold value is less than the second threshold value, the image data having 252 to 255 gray values are converted to 251 gray values and outputted in the (f+7)-th frame. In the (f+8)-th frame, the image data having 253 to 255 gray values are converted to 252 gray values and outputted. In the (f+9)-th frame, the image data having 254 to 255 gray values are converted to 253 gray values and outputted. In the (f+10)-th frame, the image data having 255 gray values is converted to 254 gray values and outputted. In the (f+11)-th frame, the image data are not converted and normal data are outputted.

When the number of cases where the difference in gray value of the adjacent pixels is continuously greater than or equal to the first threshold value in the (f+7)-th frame to the (f+10)-th frame is less than the second threshold value, the aforementioned manner may be performed. If the number of cases where the difference in gray value of the adjacent pixels is greater than or equal to the first threshold value between the (f+7)-th frame and the (f+10)-th frame is greater than or equal to the second threshold value, the recovering process for outputting normal data is stopped and the sequential converting the image data is performed.

Hereinafter, an example will be described below referring to Table 3. The third threshold value is set to 250, and converting the image data is set so that one gray value is corrected for two frames.

TABLE 3

| Frame number | Gray value before correction | Gray value after correction |
|---|---|---|
| f | 0-255 | 0-255 |
| f + 1 | 0-255 | 0-255 |
| f + 2 | 0-254/255 | 0-254/254 |
| f + 3 | 0-254/255 | 0-254/254 |
| f + 4 | 0-253/254-255 | 0-253/253 |
| f + 5 | 0-253/254-255 | 0-253/253 |
| f + 6 | 0-252/253-255 | 0-252/252 |
| f + 7 | 0-252/253-255 | 0-252/252 |
| f + 8 | 0-251/252-255 | 0-251/251 |
| f + 9 | 0-251/252-255 | 0-251/251 |
| f + 10 | 0-250/251-255 | 0-250/250 |
| f + 11 | 0-250/251-255 | 0-250/250 |

First, when the number of cases where the difference in gray value of the adjacent pixels in the f-th frame is greater than or equal to the first threshold value is greater than or equal to the second threshold value, the image data having 0 to 255 gray values are not converted and outputted of itself in the f-th frame and the (f+1)-th frame. In the (f+2)-th frame and the (f+3)-th frame, the image data having 255 gray values are converted to 254 gray values and outputted. In the (f+4)-th frame and the (f+5)-th frame, the image data having 254 to 255 gray values are converted to 253 gray values and outputted. In the (f+6)-th frame and the (f+7)-th frame, the image data having 253 to 255 gray values are converted to 252 gray values and outputted. In the (f+8)-th frame and the (f+9)-th frame, the image data having 252 to 255 gray values are converted to 251 gray values and outputted. In the (f+10)-th frame and the (f+11)-th frame, the image data having 251 to 255 gray values are converted to 250 gray values and outputted.

When the number of cases where the difference in gray value of the adjacent pixels is continuously greater than or equal to the first threshold value in the (f+1)-th frame to the (f+10)-th frame is greater than or equal to the second threshold value, the aforementioned manner may be performed. If the number of cases where the difference in gray value of the adjacent pixels is greater than or equal to the first threshold value between the (f+1)-th frame and the (f+10)-th frame is less than the second threshold value, sequential converting the image data is stopped and the recovering process for outputting normal data is performed.

Next, in the display device according to an exemplary embodiment of the present invention and the driving method thereof, a main pattern converting the image data by determining occurrence of overheating of the data driver will be described.

FIG. 6 to FIG. 13 are views showing various patterns causing overheating of a data driver. The pixel where diagonal lines are drawn has the gray value that is close to the minimum gray value and the pixel where diagonal lines are not drawn has the gray value that is close to the maximum gray value.

Figure 14:
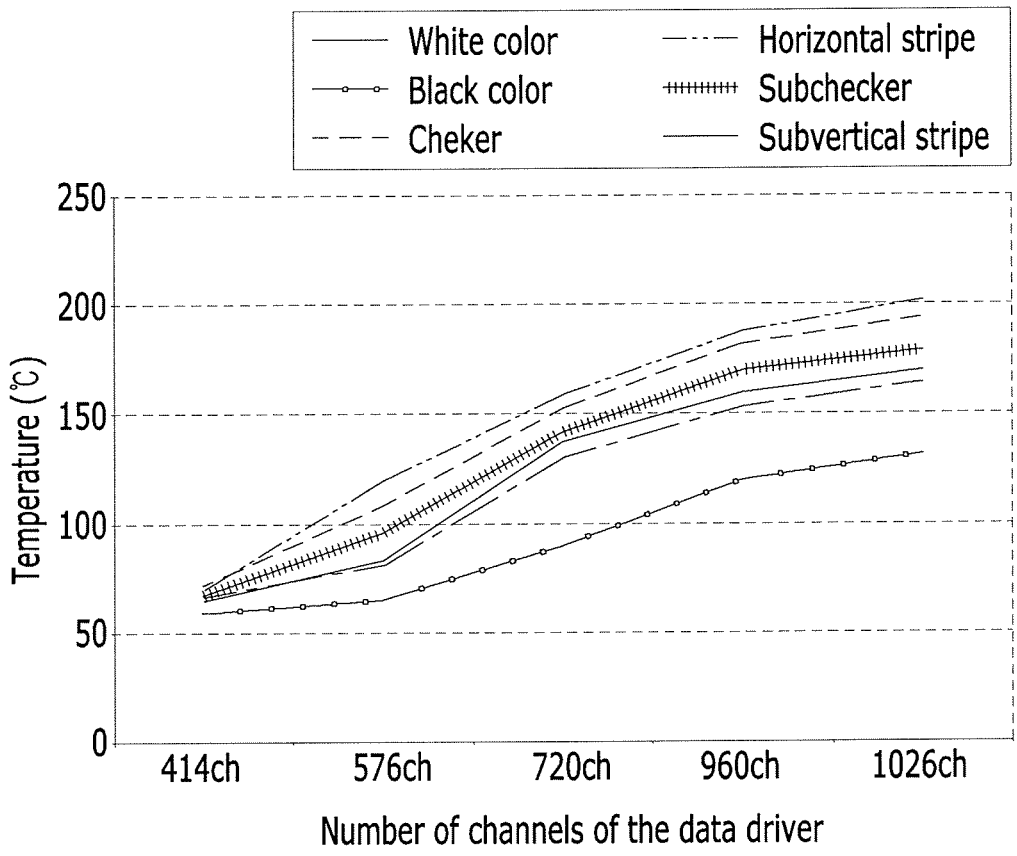
FIG. 14 is a graph showing a temperature according to the number of data lines connected to the data driver for a plurality of patterns.

FIG. 14 is a graph showing a temperature according to the number of data lines connected to the data driver for a plurality of patterns.

Figure 6:
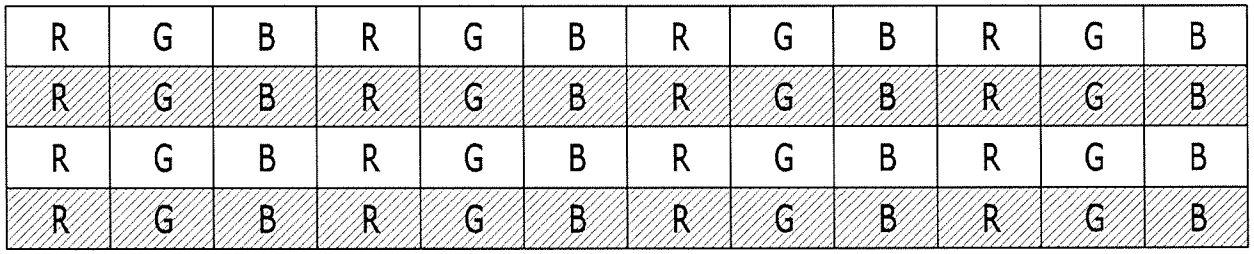
FIG. 6 to FIG. 13 are views showing various patterns causing overheating of a data driver.

FIG. 6 is a horizontal stripe pattern, in which the pixels belonging to first and third rows has the gray value that is close to the maximum gray value and the pixels belonging to second and fourth rows has the gray value that is close to the minimum gray value. If the pixels are disposed in the same direction based on the same data line, the difference in gray value of the adjacent pixels connected to the same data line has a very large value. Accordingly, overheating of the data driver may occur.

Figure 7:
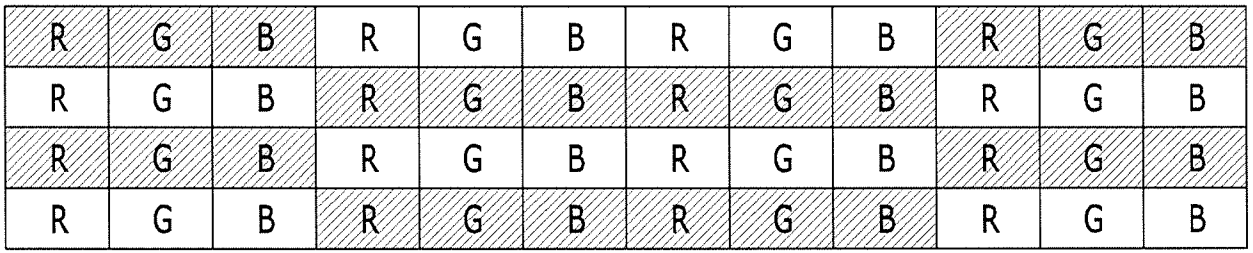

In FIG. 7, six pixels that are disposed in series among the pixels belonging to the same row have the gray value that is close to the maximum gray value, and the next six pixels have the gray value that is close to the minimum gray value. Further, the pixels that are adjacent to the pixel having the gray value that is close to the maximum gray value in a row direction have the gray value that is close to the minimum gray value. Further, the pixels that are adjacent to the pixel having the gray value that is close to the minimum gray value in a column direction have the gray value that is close to the maximum gray value.

Figure 8:
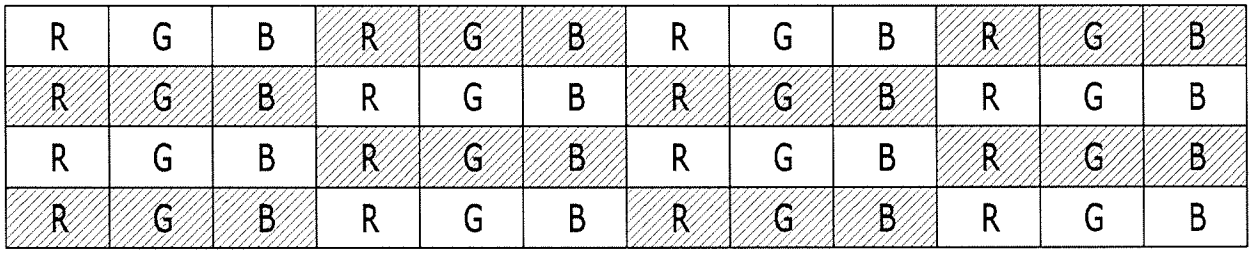

FIG. 8 is a checker pattern, in which three pixels that are disposed in series among the pixels belonging to the same row have the gray value that is close to the maximum gray value, and the next three pixels have the gray value that is close to the minimum gray value. Further, the pixels that are adjacent to the pixel having the gray value that is close to the maximum gray value in a column direction have the gray value that is close to the minimum gray value, and the pixels that are adjacent to the pixel having the gray value that is close to the minimum gray value in a column direction have the gray value that is close to the maximum gray value.

Figure 9:
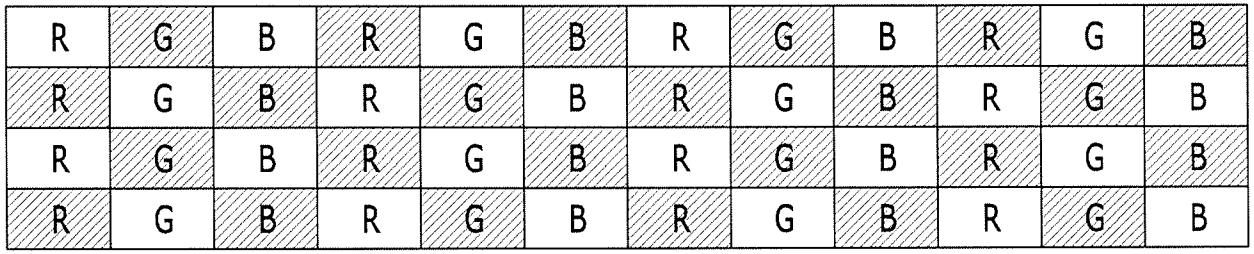

FIG. 9 is a sub-checker pattern, in which the pixel having the gray value that is close to the maximum gray value and the pixel having the gray value that is close to the minimum gray value are alternately repeated in a column direction and a row direction.

Figure 10:
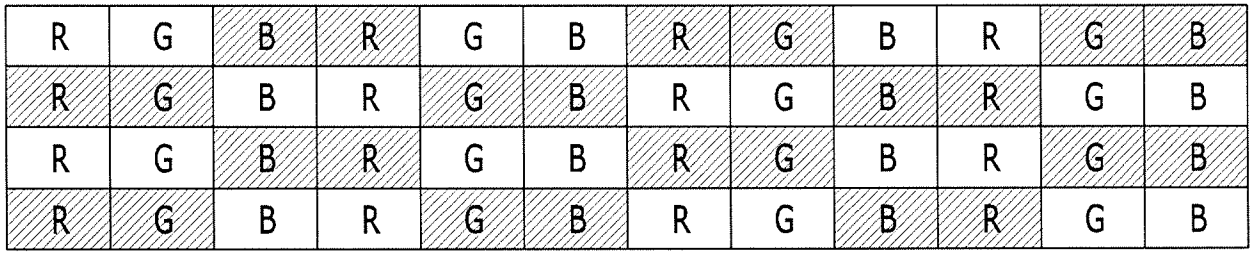

In FIG. 10, two pixels that are disposed in series among the pixels belonging to the same row have the gray value that is close to the maximum gray value, and the next two pixels have the gray value that is close to the minimum gray value. Further, the pixels that are adjacent to the pixel having the gray value that is close to the maximum gray value in a column direction have the gray value that is close to the minimum gray value, and the pixels that are adjacent to the pixel having the gray value that is close to the minimum gray value in a column direction have the gray value that is close to the maximum gray value.

Figure 11:
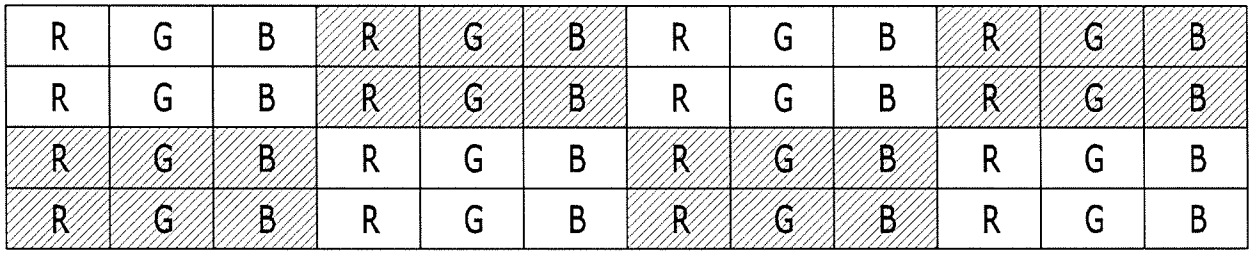

In FIG. 11, in the first and second rows, patterns repeated so that the first three pixels have the gray value that is close to the maximum gray value and the next three pixels have the gray value that is close to the minimum gray value are provided. In the third and fourth rows, patterns repeated so that the first three pixels have the gray value that is close to the minimum gray value and the next three pixels have the gray value that is close to the maximum gray value are provided.

In FIG. 6 to FIG. 10, the image data applied to the pixels connected to one data line swing for every pixel, but in FIG. 11, since the image data swing for every two pixels, relatively less overheating may occur in the data driver. However, in this case, since there is a high frequency that the difference in gray value of the adjacent pixels connected to the same data line has a large value, overheating of the data driver may occur.

Figure 12:
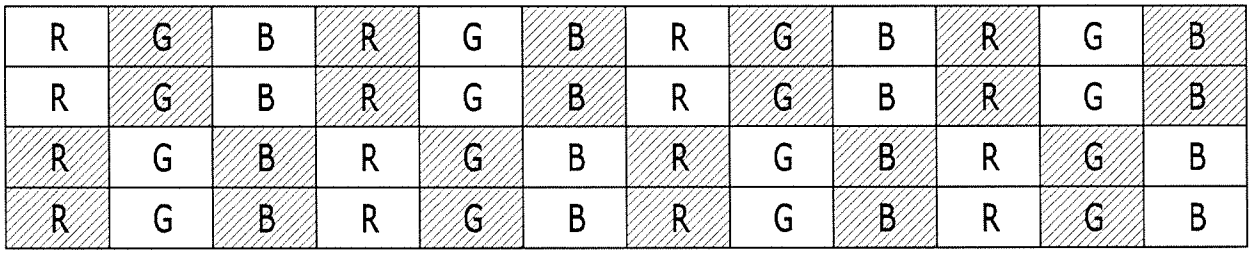

FIG. 12 has a pattern where the pixel having the gray value that is close to the maximum gray value and the pixel having the gray value that is close to the minimum gray value are repeated in the first and second rows. There is provided a pattern where the pixel having the gray value that is close to the minimum gray value and the pixel having the gray value that is close to the maximum gray value are repeated in the third and fourth rows.

Figure 13:
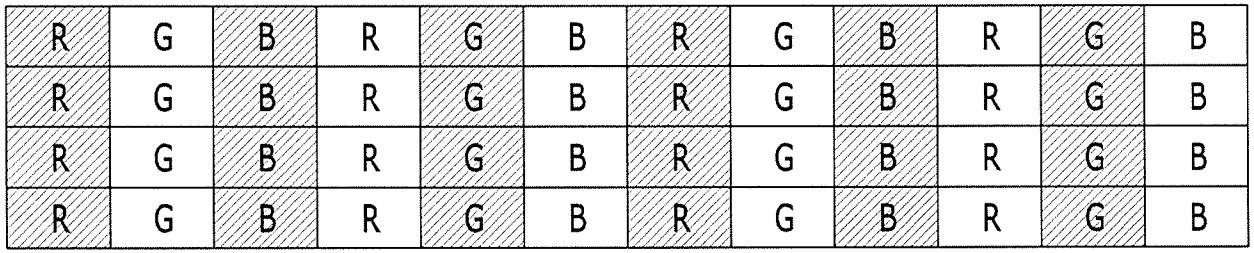

FIG. 13 is a sub-vertical stripe pattern, in which the pixels belonging to an odd numbered row has the gray that is close to the maximum gray value and the pixels belonging to an even numbered row has the gray value that is close to the minimum gray value.

In the case of the subvertical stripe pattern, if the pixels are disposed in the same direction based on the same data line, since the difference in gray value of the adjacent pixels connected to the same data line is very small, overheating of the data driver does not occur. However, when the subvertical stripe pattern is applied to the display device where the pixels are disposed in a zigzag based on the same data line, since the difference in gray value of the adjacent pixels connected to the same data line is very large, overheating of the data driver occurs.

The degree of overheating of the data driver according to a kind of pattern will be examined below through the graph shown in FIG. 14. FIG. 14 shows the case where the pixels are disposed in the same direction based on the same data line in all patterns.

In the pattern where the entire screen has a black color, the temperature of the data driver has the lowest value. In the subvertical stripe pattern and the pattern where the entire screen has a black color, the temperature of the data driver is increased as compared to the black pattern but not increased to the degree of concern about overheating. Next, the temperature of the data driver is gradually increased in the order of the sub-checker pattern, the checker pattern and the horizontal stripe pattern, and when the corresponding pattern is continued over a long period of time, there is concern about overheating of the data driver.

In the display device according to an exemplary embodiment of the present invention and the driving method thereof, the pattern where there is concern about overheating of the data driver may be detected.

Hereinafter, referring to FIG. 15, when this pattern is detected, the degree of reduction in temperature of the data driver by converting and outputting the image data will be described.

Figure 15:
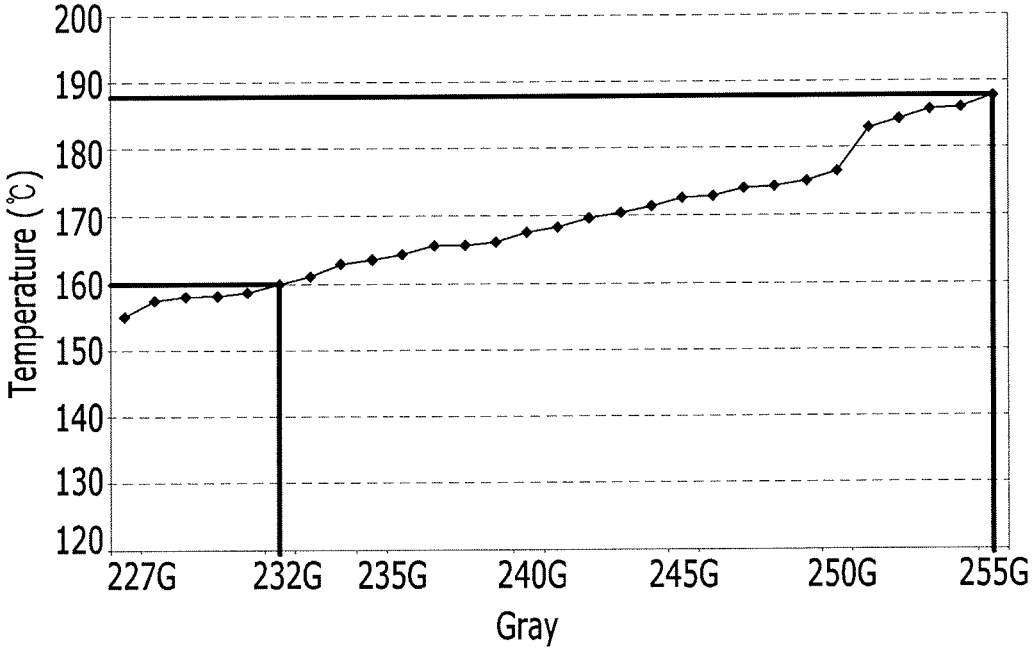
FIG. 15 is a graph showing the temperature of the data driver according to correction of a maximum gray value in a horizontal stripe pattern where a row formed of pixels having the maximum gray value and a row formed of pixels having a minimum gray value are alternately repeated.

FIG. 15 is a graph showing the temperature of the data driver according to correction of a maximum gray value in a horizontal stripe pattern where a row formed of pixels having the maximum gray value and a row formed of pixels having a minimum gray value are alternately repeated.

As shown in FIG. 15, in the case of the horizontal stripe pattern where the row formed of the pixels having 255 gray values and the row formed of the pixels having 0 gray value are alternately repeated, the temperature of the data driver is measured to be 188° C. It can be confirmed that as the maximum gray value is gradually reduced from 255 gray values, the temperature of the data driver is reduced. When the maximum gray value is reduced to 227 gray values, the temperature of the data driver is measured to be 155° C.

For example, if the pixels having 255 gray values are converted to have 232 gray values in the horizontal stripe pattern, the temperature of the data driver may be reduced to about 30° C. A change in luminance of the screen according to the gray value correction is not visible. Further, when there is concern that a change in luminance is visible, as described above, if converting the image data is sequentially performed during a plurality of frames, the change can be prevented.

While this invention has been described in connection with what is presently considered to be practical exemplary embodiments, it is to be understood that the invention is not limited to the disclosed embodiments, but, on the contrary, is intended to cover various modifications and equivalent arrangements.

What is claimed is:

1. A display device comprising:

a display panel including a plurality of gate lines, a plurality of data lines and a plurality of pixels connected to the plurality of gate lines and the plurality of data lines;

a gate driver supplying a gate signal to the plurality of gate lines; a data driver supplying a data signal to the plurality data lines; and a signal controller controlling the gate signal and the data signal, wherein the signal controller includes a data converter converting a gray value of image data when a difference in a gray value of the image data of two adjacent pixels of the plurality of pixels connected to a same data line of the plurality of data lines is greater than or equal to a first threshold value, wherein: the data converter includes:

a data comparator counting a number of cases where the difference in the gray value of the image data of the two adjacent pixels connected to the same data line is greater than or equal to the first threshold value and determining whether the number of cases is greater than or equal to a second threshold value; and a gray value corrector converting the gray value of the image data when the number of cases is greater than or equal to the second threshold value, and the data comparator:

counts, when the plurality of pixels is disposed in a zigzag with respect to the plurality of data lines, and counts the number of cases where the difference is greater than or equal to the first threshold value by comparing the differences in the gray values of the image data of two pixels of the plurality of pixels that are adjacent in a diagonal direction.

2. The display device of claim 1, wherein:

the data comparator determines that the difference in the gray value of the image data of the two adjacent pixels is greater than or equal to the first threshold value when:

the gray value of any one pixel of the two adjacent pixels is greater than or equal to a threshold value h and the gray value of the other pixel of the two adjacent pixels is less than or equal to a threshold value l, and the gray value of any one pixel of the two adjacent pixels is less than or equal to the threshold value l and the gray value of the other pixel of the two adjacent pixels is greater than or equal to the threshold value h.

3. The display device of claim 1, wherein:

the gray value corrector corrects, the gray value of the image data having the gray value exceeding a third threshold value to the third threshold value when:

the number of cases is greater than or equal to the second threshold value.

4. The display device of claim 3, wherein:

the gray value corrector sequentially reduces the gray values of the image data having the gray value exceeding the third threshold value during a plurality of frames to correct the gray value to the third threshold value.

5. The display device of claim 1, wherein:

the data comparator counts the number by comparing the gray values of the entire image data of one frame, and the gray value corrector converts the gray value of the image data of the next frame when the number is greater than or equal to the second threshold value.

6. The display device of claim 1, wherein:

the data driver includes a plurality of data driving units, and the data comparator counts the number of cases for each of the plurality of data driving units.

7. The display device of claim 6, wherein:

the gray value corrector converts the gray value of the image data when the number of cases in any one data driving unit of the plurality of data driving units is greater than or equal to the second threshold value.

8. A display device comprising:

a display panel including a plurality of gate lines, a plurality of data lines and a plurality of pixels connected to the plurality of gate lines and the plurality of data lines;

a gate driver supplying a gate signal to the plurality of gate lines; a data driver supplying a data signal to the plurality data lines; and a signal controller controlling the gate signal and the data signal, wherein the signal controller includes a data converter converting a gray value of image data when a difference in a gray value of the image data of two adjacent pixels of the plurality of pixels connected to a same data line of the plurality of data lines is greater than or equal to a first threshold value, wherein: the data converter includes:

a data comparator counting a number of cases where the difference in the gray value of the image data of the two adjacent pixels connected to the same data line is greater than or equal to the first threshold value and determining whether the number of cases is greater than or equal to a second threshold value; and a gray value corrector converting the gray value of the image data when the number of cases is greater than or equal to the second threshold value, and the data converter further includes:

a data mapper re-disposing the plurality of pixels such that the image data of the two adjacent pixels of the plurality of pixels that are adjacent in a diagonal direction become adjacent to each other in a data line direction when the pixels are disposed in a zigzag with respect to the data lines.

9. The display device of claim 8, wherein:

the data comparator determines that the difference in the gray value of the image data of the two adjacent pixels is greater than or equal to the first threshold value when:

the gray value of any one pixel of the two adjacent pixels is greater than or equal to a threshold value h and the gray value of the other pixel of the two adjacent pixels is less than or equal to a threshold value l , and the gray value of any one pixel of the two adjacent pixels is less than or equal to the threshold value l and the gray value of the other pixel of the two adjacent pixels is greater than or equal to the threshold value h.

10. The display device of claim 8, wherein:

the gray value corrector corrects, the gray value of the image data having the gray value exceeding a third threshold value to the third threshold value when:

the number of cases is greater than or equal to the second threshold value.

11. The display device of claim 10, wherein:

the gray value corrector sequentially reduces the gray values of the image data having the gray value exceeding the third threshold value during a plurality of frames to correct the gray value to the third threshold value.

12. The display device of claim 8, wherein:

the data comparator counts the number by comparing the gray values of the entire image data of one frame, and the gray value corrector converts the gray value of the image data of the next frame when the number is greater than or equal to the second threshold value.

13. The display device of claim 8, wherein:

the data driver includes a plurality of data driving units, and the data comparator counts the number of cases for each of the plurality of data driving units.

14. The display device of claim 13, wherein:

the gray value corrector converts the gray value of the image data when the number of cases in any one data driving unit of the plurality of data driving units is greater than or equal to the second threshold value.

15. A driving method of a display device, comprising:

counting a number of cases where a difference in a gray value of image data of two adjacent pixels connected to a same data line among a plurality of data lines is greater than or equal to a first threshold value;

determining whether the number of cases is greater than or equal to a second threshold value; and converting the gray value of the image data when the number of cases is greater than or equal to the second threshold value; and outputting the converted image data, wherein the display device includes a plurality of pixels connected to the data lines, and in the counting of the number of cases where the difference in the gray value of image data of the two adjacent pixels is greater than or equal to the first threshold value, when the plurality of pixels are disposed in a zigzag with respect to the data lines, the number of cases where the difference is greater than or equal to the first threshold value is counted by comparing the differences in the gray value of the image data of the two adjacent pixels, that are adjacent in a diagonal direction.

16. The driving method of a display device of claim 15, wherein:

the gray value of the image data is not converted and the image data is outputted when the number is less than the second threshold value.

17. The driving method of a display device of claim 15, wherein:

in the counting of the number of cases where the difference in the gray value of image data of the two adjacent pixels is greater than or equal to a first threshold value, when the gray value of any one pixel of the two adjacent pixels is greater than or equal to a threshold value h and the gray value of the other pixel is less than or equal to a threshold value l, and when the gray value of any one pixel of the two adjacent pixels is less than or equal to the threshold value l and the gray value of the other pixel is greater than or equal to the threshold value h, determining that the difference in the gray value of the image data of the two adjacent pixels is greater than or equal to the first threshold value is performed.

18. The driving method of a display device of claim 15, wherein:

in converting the gray value of the image data, when the number is greater than or equal to the second threshold value, the gray value of the image data having the gray value exceeding a third threshold value is corrected to the third threshold value.

19. The driving method of a display device of claim 18, wherein:

in converting the gray value of the image data, the gray value of the image data exceeding the third threshold value is sequentially reduced over a plurality of frames to bring the gray value to the third threshold value.

20. The driving method of a display device of claim 15, wherein:

in the counting of the number of cases where the difference in the gray value of image data of the two adjacent pixels is greater than or equal to the first threshold value, the number of cases is counted by comparing the gray value of the entire image data of one frame, and in converting the gray value of the image data, the gray value of the image data of the next frame is converted when the number is greater than or equal to the second threshold value.

21. The driving method of a display device of claim 15, wherein:

the plurality of data lines are separately connected to a plurality of data drivers, in the counting of the number of cases where the difference in the gray value of image data of the two adjacent pixels is greater than or equal to the first threshold value, the number is counted for each of a plurality of data drivers.

22. The driving method of a display device of claim 21, wherein:

in converting the gray value of the image data, the gray value of the image data is converted when the number in any one data driver of the plurality of data drivers is greater than or equal to the second threshold value.

23. A driving method of a display device, comprising:

counting a number of cases where a difference in a gray value of image data of two adjacent pixels connected to a same data line among a plurality of data lines is greater than or equal to a first threshold value;

determining whether the number of cases is greater than or equal to a second threshold value; and converting the gray value of the image data when the number of cases is greater than or equal to the second threshold value; and outputting the converted image data, wherein the display device includes a plurality of pixels connected to the data lines, and before the counting of the number of cases where the difference in the gray value of image data of the two adjacent pixels is greater than or equal to the first threshold value, the driving method further includes re-disposing the pixels so that the image data of the two adjacent pixels, that are adjacent in a diagonal direction, are adjacent to each other in a data line direction when the plurality of pixels are disposed in a zigzag with respect to the data lines.

24. The driving method of a display device of claim 23, wherein:

the gray value of the image data is not converted and the image data is outputted when the number is less than the second threshold value.

25. The driving method of a display device of claim 23, wherein:

in the counting of the number of cases where the difference in the gray value of image data of the two adjacent pixels is greater than or equal to a first threshold value, when the gray value of any one pixel of the two adjacent pixels is greater than or equal to a threshold value h and the gray value of the other pixel is less than or equal to a threshold value l, and when the gray value of any one pixel of the two adjacent pixels is less than or equal to the threshold value l and the gray value of the other pixel is greater than or equal to the threshold value h, determining that the difference in the gray value of the image data of the two adjacent pixels is greater than or equal to the first threshold value is performed.

26. The driving method of a display device of claim 23, wherein:

in converting the gray value of the image data, when the number is greater than or equal to the second threshold value, the gray value of the image data having the gray value exceeding a third threshold value is corrected to the third threshold value.

27. The driving method of a display device of claim 26, wherein:

in converting the gray value of the image data, the gray value of the image data exceeding the third threshold value is sequentially reduced over a plurality of frames to bring the gray value to the third threshold value.

28. The driving method of a display device of claim 23, wherein:

in the counting of the number of cases where the difference in the gray value of image data of the two adjacent pixels is greater than or equal to the first threshold value, the number of cases is counted by comparing the gray value of the entire image data of one frame, and in converting the gray value of the image data, the gray value of the image data of the next frame is converted when the number is greater than or equal to the second threshold value.

29. The driving method of a display device of claim 23, wherein:

the plurality of data lines are separately connected to a plurality of data drivers, in the counting of the number of cases where the difference in the gray value of image data of the two adjacent pixels is greater than or equal to the first threshold value, the number is counted for each of a plurality of data drivers.

30. The driving method of a display device of claim 29, wherein:

in converting the gray value of the image data, the gray value of the image data is converted when the number in any one data driver of the plurality of data drivers is greater than or equal to the second threshold value.

* * * * *